US005515793A

United States Patent [19]

Ikeda

[11] Patent Number: 5,515,793

[45] Date of Patent: May 14, 1996

[54] INCINERATION FURNACE

[75] Inventor: Toshio Ikeda, Sagamihara, Japan

[73] Assignee: Nessy Kogyo Kabushiki Kaisha, Kanagawa, Japan

[21] Appl. No.: 442,877

[22] Filed: May 17, 1995

[30] Foreign Application Priority Data

May 17, 1994 [JP] Japan ..... 6-102656

[51] Int. Cl.[6] ..... F23G 5/44

[52] U.S. Cl. ..... 110/247; 432/139; 110/225

[58] Field of Search ..... 110/225, 247, 110/248, 258; 432/139

[56] References Cited

U.S. PATENT DOCUMENTS

| | | | |
|---|---|---|---|
| 1,758,805 | 5/1930 | Ridge | 432/139 |
| 3,671,167 | 6/1972 | Nakano | 110/247 |
| 3,824,935 | 7/1974 | Yamato et al. | 110/258 |
| 4,215,981 | 8/1980 | Von Dreusche | 110/225 |
| 4,391,208 | 7/1983 | Lewis | 432/139 |
| 5,094,177 | 3/1992 | Lado | 110/225 |

*Primary Examiner*—Marguerite Macy
*Attorney, Agent, or Firm*—Paul A. Guss

[57] ABSTRACT

An incineration furnace for disposal of waste in which substantially complete burning of waste materials is obtained. A stirring member is rotatably supported in the interior of an incinerator housing, making up the main incineration furnace body. Air for accelerating burning of the waste material is forcibly fed from a blower through the stirring member. The stirring member is rotated and driven through the inside of the housing by a motor. Waste is agitated and mixed between movable tubes provided on the stirring member, and by first and second fixed blades disposed in the incinerator housing, thereby facilitating burning and incineration of the waste material.

3 Claims, 4 Drawing Sheets

INCINERATION FURNACE

BACKGROUND OF THE INVENTION

1. Field of the Invention

The present invention relates to an incineration furnace in which a whirling flow of air is generated while simultaneously performing stirring, so that waste is incinerated and processed.

2. Description of the Related Art

Incineration furnaces have been widely used in order to dispose of general waste discarded from domestic settings, or to dispose of industrial waste discarded from factories and so on. Such a furnace is generally made up of a housing having a hearth. Waste is gradually or collectively introduced into the housing, a fire is ignited from an upper or lower portion of the housing, and the waste is burned.

As previously known, waste nowadays includes garbage, plastic products, and so on, ranging in extensive varieties in terms of types and sizes. When such waste materials are collectively burned and processed, extreme amounts of residues are generated and post-processing becomes troublesome and complicated. In addition, harmful gases may be generated during burning, causing secondary environmental pollution.

SUMMARY OF THE INVENTION

The present invention is directed to solving the problems described above, wherein an object of the invention is to provide an incineration furnace which can completely incinerate a variety of waste materials without fear of generating harmful gases, while also being compact in size.

In order to accomplish the objects described above, the present invention lies in an incineration furnace comprising:

a main incineration furnace body;

a stirring means provided on the inside of the main incineration furnace body, the stirring means including a plurality of separated vane members;

a rotational driving source for rotating and driving the stirring means; and fixed blades provided on the inside of the main incineration furnace body, the fixed blades being relatively interposed between the plurality of separated vane members under the rotating action of the stirring means;

wherein the stirring means is formed of a hollow shape, and has a plurality of air jetting ports defined thereon.

A fire is ignited after introducing waste into the inside of the main incineration furnace body. Subsequently, the rotational driving source is energized to rotate and drive the stirring means. Thus, the vane members secured to the stirring means effectively stir and grind the waste in cooperation with the fixed blades. Owing to such an action, air penetrates sufficiently into the interior and toward the bottom of the stacked waste, facilitating burning of the waste material.

Furthermore, air is vigorously jetted through the air-jetting ports provided on the stirring means, thereby forming a whirling flow of air to further increase the burning action, and retain burning gas inside of the incineration furnace for a longer period. Thus, a substantially complete and uniform burning is achieved.

BRIEF DESCRIPTION OF THE DRAWINGS

Other objects and advantages of the present invention will be more easily and clearly understood from a preferred embodiment of the invention which shall be explained hereinafter in detail with reference to the attached drawings, wherein.

DETAILED DESCRIPTION OF THE PREFERRED EMBODIMENTS

The incineration furnace according to the present invention will herein be described by reference to a preferred embodiment, and explained below in detail with reference to the attached drawings. It shall be apparent, however, that various modifications to the preferred embodiment could be readily envisaged by persons of ordinary skill in the art without departing from the spirit of the invention, and the invention shall not be construed as limited solely to any disclosed embodiment.

Figure 1:
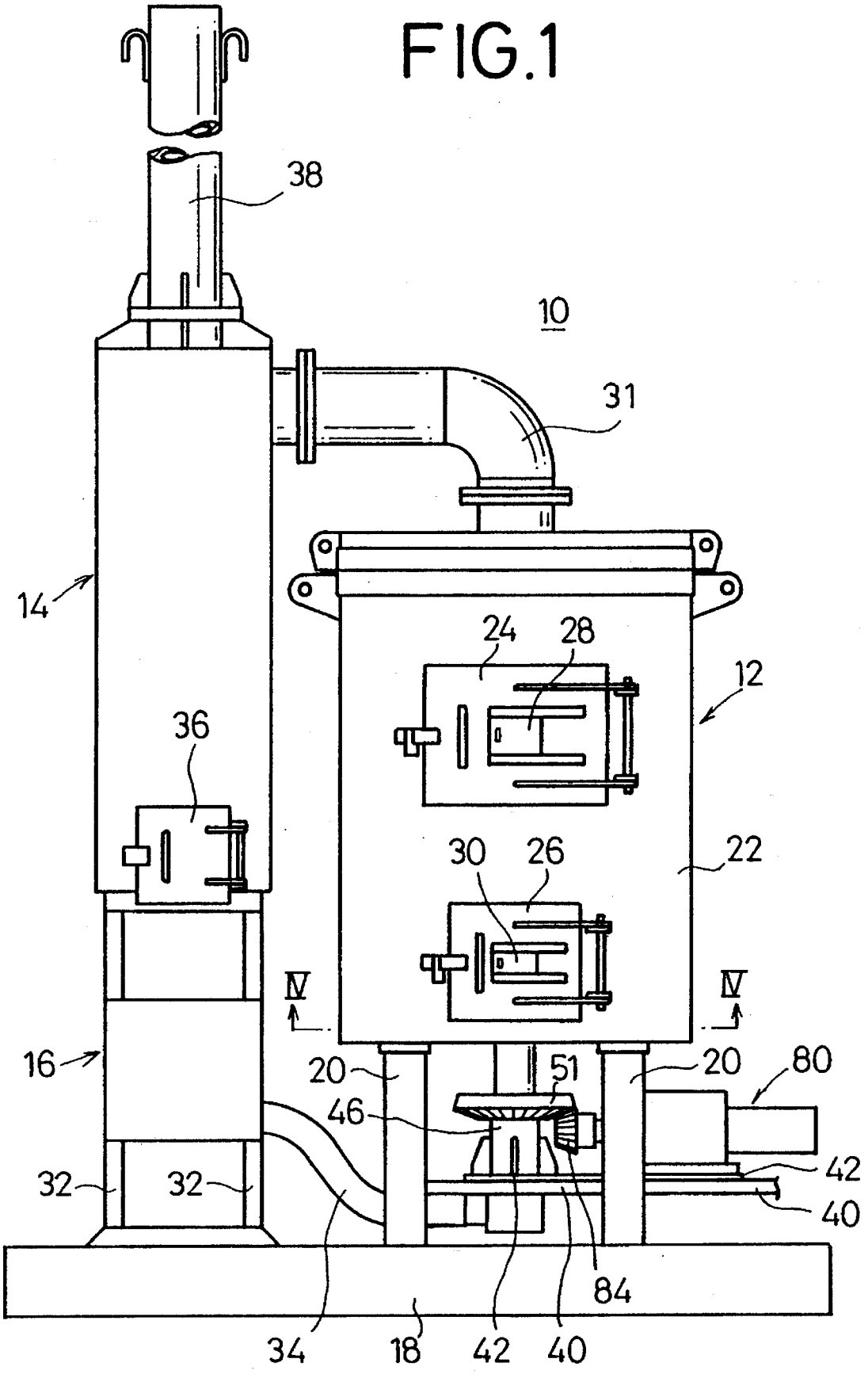
FIG. 1 is a schematic frontal view of an incineration furnace according to the present invention.

In FIG. 1, reference numeral 10 indicates an incineration furnace according to the present invention. The incineration furnace 10 basically comprises a main incineration furnace body 12, a cyclonic flue 14, and a blower 16. The main incineration furnace 12, cyclonic flue 14 and blower 16 are placed on a pedestal 18. A housing 22 constituting the main incineration furnace body 12 is secured on a plurality of legs 20 extending upwardly from the pedestal 18. A first furnace door 24 and a second furnace door 26 are provided at upper and lower positions on the front face of the housing 22 in a manner so that the doors 24 and 26 may be freely opened and closed. The first furnace door 24 is provided with a window 28 through which the inside of the housing 22 is visible. The second furnace door 26 is similarly provided with a window 30 in the same manner. A duct 31 extends upwardly and bends from a top portion of the housing 22, and the duct 31 communicates with an upper portion of the cyclonic flue 14.

The blower 16 is supported on the pedestal 18 through a plurality of legs 32. A tube 34 extends from a blowing mechanism (not shown) of the blower 16, and a forward end of the tube 34 extends to a position underneath the housing 22. Legs 32 support the blower 16, and further upper ends of the legs also support the cyclonic flue 14. The cyclonic flue 14 also has a door 36 on a side wall thereof which may be freely opened and closed. Ash and the like collected in the bottom of the cyclonic flue 14 can be withdrawn through the door 36. In the drawing, reference numeral 38 indicates an exhaust tube connected to and communicating with an upper end of the cyclonic flue 14. The cyclonic flue 14 and the blower 16 are basically conventional structures known in the art, and hence their detailed description and operation need not be provided for a full understanding of the present invention.

Specific features of the main incineration furnace body 12 shall be explained below with reference to FIG. 2. A support plate 40 is secured between the four legs 20 of the main incineration furnace body 12. A plate 42 is further fixed to the support plate 40. A hollow connector 44 for receiving the forward end of the tube 34 is secured to the plate 42. A shaft member 46 is secured to the plate 42 such that it enters the inside of the connector 44. A hollow air-introducing tube 50 is rotatably supported by the shaft member 46 through a bearing 48. A lower end of the air-introducing tube 50 faces the connector 44, while a bevel gear is secured approximately at the middle of the air-introducing tube 50. A vertical tube section 54 of a stirring member 52, the stirring member 52 having an overall T-shaped vertical cross section, is fitted to the air-introducing tube 50 at a forward upper end thereof through a bolt 56.

The stirring member 52 has a hollow or cylindrical horizontal tube section 58 formed integrally with the vertical tube section 54. The horizontal tube section 58 has a first horizontal tube section 58*a* and a second horizontal tube section 58*b*. First through fourth movable tubes 60*a* through 60*d*, serving as vane members, extend downward from bottom portions of the horizontal tube section 58 and are separated by predetermined spacings.

A plurality of holes 62 are formed on the vertical tube section 54 along its axis. A first group of holes 64 and a second group of holes 66 are formed on respective parts of the horizontal tube section 58 in the axial direction thereof, the holes 64 and 66 being separated by predetermined spacings. As shown in FIG. 2, it will be easily and clearly understood that the number of holes belonging to the second group 64 is much greater than the number of holes belonging to the first group 66.

First and second fixed blades 68, 70 are detachably provided at a bottom portion of the housing 22, so that they face the spacing between the movable tubes 60*a*, 60*b* and between the movable tubes 60*c*, 60*d*, respectively. More specifically, the first and second fixed blades 68, 70 are plate-shaped, and are constructed to be disposed at different respective angles. Hence, the fixed blades 68 and 70 are allowed to come into relative intervention between the movable tubes 60*a*, 60*b* and between the movable tubes 60*c*, 60*d* as the stirring member 52 rotates, as may be clearly seen in FIG. 4.

Figure 2:
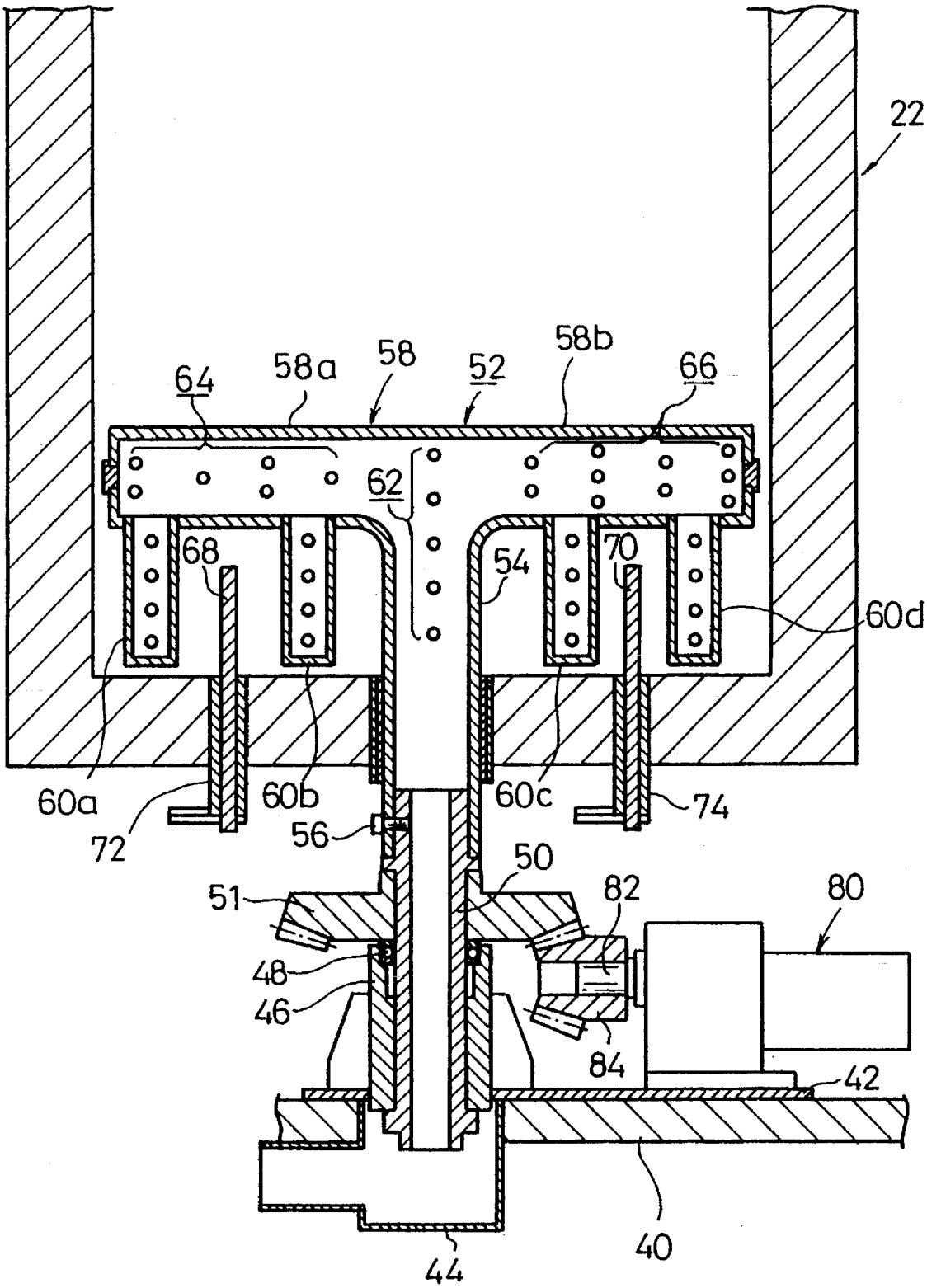
FIG. 2 is a vertical cross-sectional view, with partial omission, showing the mutual assembly of the stirring member, the rotational driving source, and an air-introducing tube of the incineration furnace according to the present invention.
Figure 3:
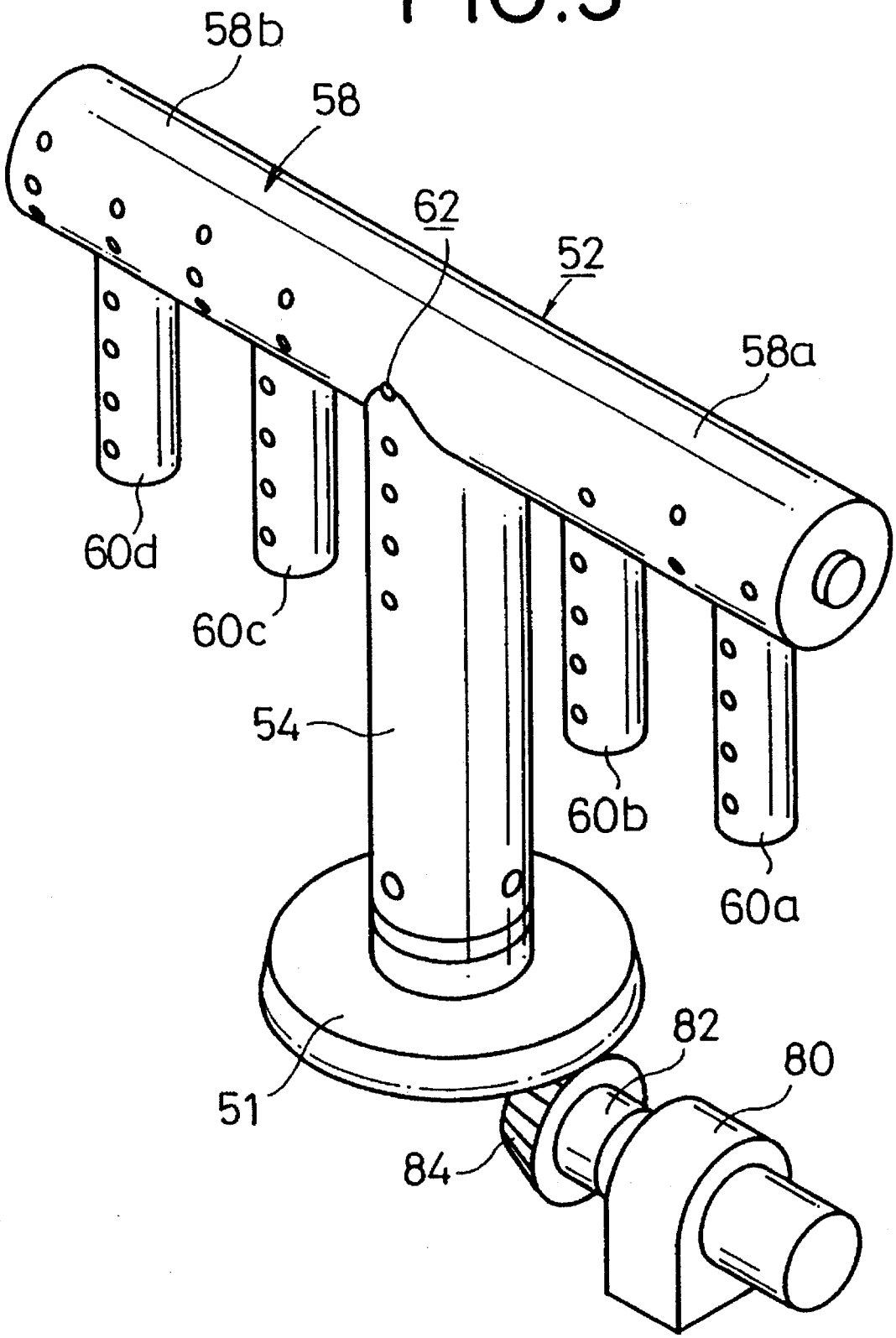
FIG. 3 is a perspective view showing the positional relationship between the stirring member and the rotational driving source shown in FIG. 2.
Figure 4:
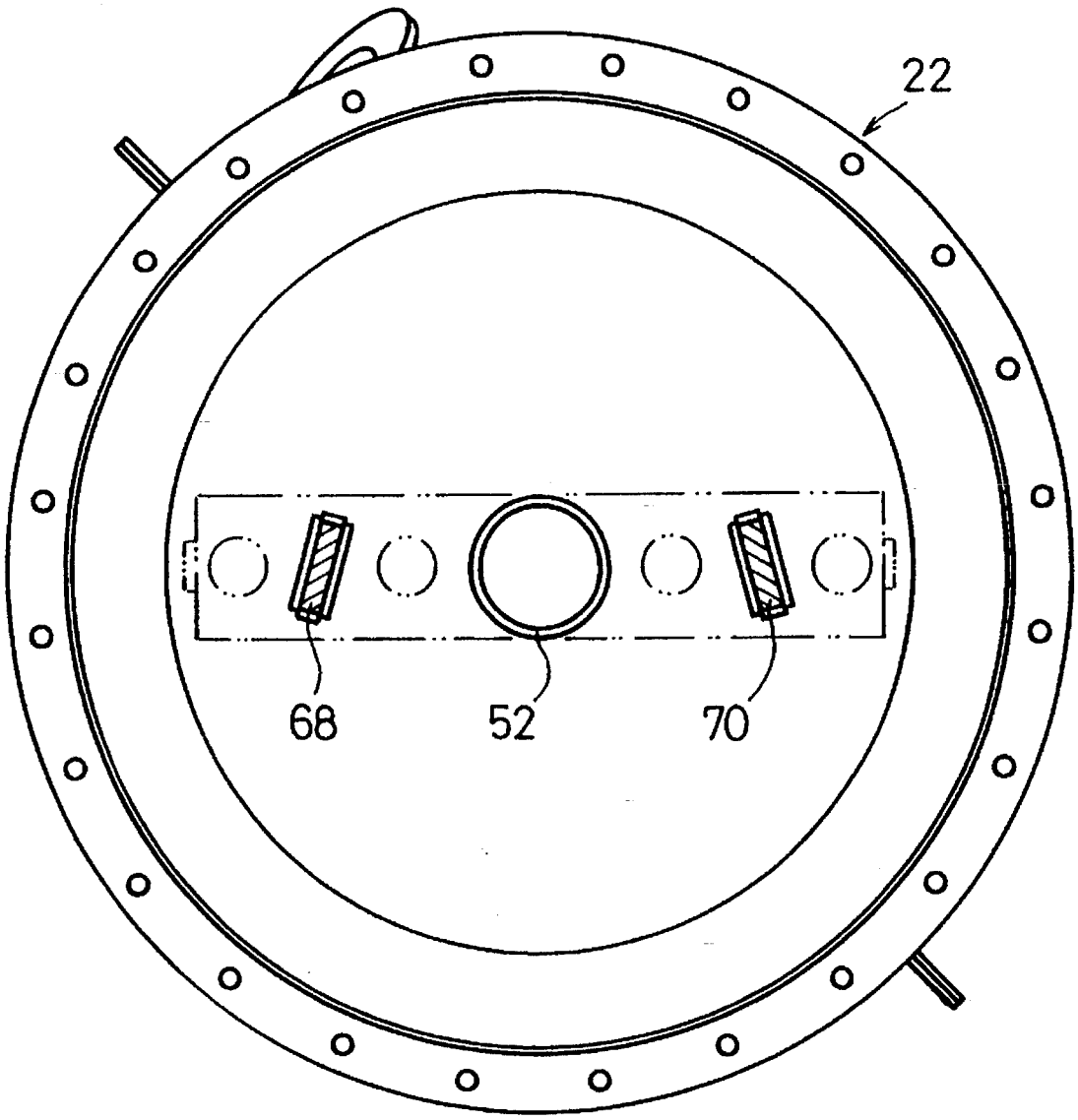
FIG. 4 is a cross-sectional view taken along line IV—IV of FIG. 1.

As easily and clearly understood from FIG. 2 and FIG. 4, the first and second fixed blades 68, 70 are plate-shaped. Thus, the fixed blades 68 and 70 may be inserted into bottom portions of the housing 22 through guide members 72, 74 and lower ends of the fixed blades may be fastened therein by any suitable means such as bolt or pin members (not shown).

A motor 80, serving as a rotational driving source, is fixed on the plate 42. A bevel gear 84 is coaxially secured to the driving shaft 82 of the motor, and the bevel gear 84 engages with a further bevel gear 51 in engagement with the vertical section 54 of the stirring member 52.

The incineration furnace according to the present invention is basically constructed as described above. Next, its operation and effects shall be explained.

The first furnace door 24 is opened and general domestic waste, or industrial waste, is introduced into the interior of the main incineration furnace body. The second furnace door 26 is opened, and fire is set to the waste. Simultaneously, air for facilitating burning is forcibly fed to the inside of the housing 22 from the blower 16 through the tube 34. At this time, the driving shaft 82 is rotated by energizing the motor 80, and rotational force from the motor is transmitted through bevel gears 84 and 51 to rotate the air-introducing tube 50 and the stirring member 52 in an integral manner. Air for facilitating burning, which is introduced through the tube 34, passes through the connector 44 and the air-introducing tube 50, arriving at the vertical tube section 54, and passes through the first and second groups of holes 64, 66 of the horizontal tube section 58. At this time, air is vigorously discharged through the holes 62 of the vertical tube section 54 and through the first and second groups of holes 64, 66 in the horizontal tube section 58. Air for facilitating burning is also discharged through the movable tubes 60*a* through 60*d* in the same manner.

Thus, the movable tubes 60*a* through 60*d* rotate integrally with the stirring member 52. At this time, waste (not shown) is accumulated at the bottom of the housing 22 and is stirred by the movable tubes 60*a* through 60*d*. A portion of the waste abuts against the first and second fixed blades 68, 70 under the action of the movable tubes 60*a* through 60*d*. Thus, a forced mixing of the waste is mutually effected by the movable tubes and the fixed blades. For example, in the case of a granular industrial waste, since the first and second fixed blades 68, 70 are provided with respectively different angles as shown in FIG. 4, when the waste material is agitated under the rotating action of the movable tubes 60*a* through 60*d*, the waste becomes displaced in different directions as a result of the differing inclination angles of the first and second fixed blades 68, 70. Accordingly, mixing of the waste material is efficiently performed.

In the horizontal tube section 58, the second group of holes 66 is greater in number than the first group of holes 64, and hence more air is jetted through the holes 66. A difference in the intensity of the air jetted from the first and second groups of holes thereby results on respective sides, and thus the orientation of air flow remains constant in the housing 22. Accordingly, a whirling flow is generated in the incineration furnace 10 and is directed in a constant direction toward the fire generated by the burning of the waste, thereby accelerating burning and creating a whirling burning action within the incineration furnace. Further, gases generated during burning remain in the housing for a longer period, and do not quickly rise upwardly through the housing as would be the case in the absence of such a whirling burning action. Therefore, a substantially full and complete incineration of the waste material can be accomplished.

Smoke or the like, containing fine particles generated as a result of the burning action, passes through the duct 31 into the cyclonic flue 14, and the particulate matter therein falls downwardly in the flue toward a region near the door 36 as a result of cyclonic flows generated inside the flue 14. Heated air devoid of such particles is discharged to the outside through the tube 38.

When the first and second fixed blades 68, 70 become deteriorated in quality after operation of the incinerating furnace over long periods of time, for example, the fixed blades may be withdrawn from the guide members 72, 74 and replaced with new or refinished blade members. The stirring member 52 may likewise be replaced with a new or refinished member simply by disengaging the bolt 56 from the air-introducing tube 50.

Further, in practicing the present invention, an inorganic catalyst comprising, for example, quartz sand or the like may be charged into the interior of the housing 22 to a height of about 10 mm. When an inorganic catalyst such as quartz sand is provided, even waste in a liquid state can be introduced in the incineration furnace, and an instantaneous reaction occurs between the quartz sand and the liquid waste enabling the burning of liquid waste components. Furthermore, the first and second fixed blades 68, 70 and the stirring member 52 further facilitate exhumation of the quartz sand, so that mixing and agitation of the waste material is still effected, enabling the incineration and disposal of liquid waste materials as well.

Furthermore, burning of waste while simultaneously stirring the waste material provides a unique operation and effect in that more uniform burning can be accomplished.

According to the present invention, as described hereinabove, a stirring means is provided, and air for facilitating burning is forcibly fed through the stirring means causing a whirling flow of air within the housing. Accordingly, waste in the housing is subject to a mixing action caused by the rotation of the stirring means, and then forcibly burned by air fed through the stirring means. Fire generated during burning likewise forms a whirling flow inside the housing. Therefore, substantially complete and uniform burning of the waste can be effected. Further, as the fire is forced to whirl throughout the incineration furnace, a unique effect is obtained in that the burning temperature is further raised, and complete burning is achieved.

Additionally, further advantages are provided in that the incineration furnace according to the present invention is easily maintained and managed, owing to its mechanical construction, and the incineration furnace can be produced inexpensively as a result of its uncomplicated structure.

What is claimed is:

1. An incineration furnace comprising:

a main incineration furnace body;

a stirring means provided inside of said main incineration furnace body, said stirring means comprising a plurality of separated vane members;

a rotational driving source for rotating and driving said stirring means; and fixed blades provided on an inside of said main incineration furnace body, said fixed blades being interposed relatively between said plurality of separated vane members as said stirring means rotates;

wherein said stirring means comprises a hollow body having a plurality of air-jetting ports defined thereon.

2. The incineration furnace according to claim 1, wherein said stirring means includes a vertical tube section joined to a rotational driving shaft, and a pair of horizontal tube sections extending in opposite directions to one another from said vertical tube section.

3. The incineration furnace according to claim 2, wherein the number of said air-jetting ports defined on one of said horizontal tube sections is greater than the number of air-jetting ports defined on the other horizontal tube section.

* * * * *